US011453980B2

(12) United States Patent
Wang et al.

(10) Patent No.: US 11,453,980 B2
(45) Date of Patent: Sep. 27, 2022

(54) TURNOUT AND TURNOUT ASSEMBLY

(71) Applicant: BYD COMPANY LIMITED, Shenzhen (CN)

(72) Inventors: Yanyun Wang, Shenzhen (CN); Linna Li, Shenzhen (CN); Hao Zeng, Shenzhen (CN); Ruru Niu, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 642 days.

(21) Appl. No.: 16/475,172

(22) PCT Filed: Jun. 20, 2017

(86) PCT No.: PCT/CN2017/089200
§ 371 (c)(1),
(2) Date: Jul. 1, 2019

(87) PCT Pub. No.: WO2018/120678
PCT Pub. Date: Jul. 5, 2018

(65) Prior Publication Data

US 2019/0338469 A1 Nov. 7, 2019

(30) Foreign Application Priority Data

Dec. 29, 2016 (CN) ..... 201611250107.7

(51) Int. Cl.
*E01B 25/12* (2006.01)
*E01B 7/14* (2006.01)
(Continued)

(52) U.S. Cl.
CPC ..... *E01B 7/14* (2013.01); *B61L 5/04* (2013.01); *B61L 5/10* (2013.01); *E01B 25/12* (2013.01); *E01B 2202/025* (2013.01)

(58) Field of Classification Search
CPC .. E01B 7/14; E01B 2202/025; E01B 2202/02; E01B 25/00; E01B 23/06;
(Continued)

(56) References Cited

U.S. PATENT DOCUMENTS 224,157 A * 2/1880 Donkersley ..... E01B 7/08 246/430
1,078,051 A * 11/1913 Libby ..... E01B 25/26 104/102
(Continued)

FOREIGN PATENT DOCUMENTS

CN 2687162 Y 3/2005
CN 101214818 A 7/2008
(Continued)

OTHER PUBLICATIONS

English Translation of International Search Report from PCT/CN2017/089200 dated Oct. 11, 2017 (2 pages).

*Primary Examiner* — Mark T Le
(74) *Attorney, Agent, or Firm* — Calfee Halter & Griswold LLP

(57) ABSTRACT

A turnout includes a fixed beam, and a first and a second movable beams respectively on two opposite sides of the fixed beam. The fixed beam is arranged on a turnout platform. The first movable beam is movably arranged on the turnout platform between a first and a second positions. The second movable beam is movably arranged on the turnout platform between a third and a fourth positions. When the first movable beam is at the first position, the second movable beam is at the third position, the first movable beam is separated from the fixed beam, and the second movable beam and the fixed beam form a first passage; when the first movable beam is at the second position, the second movable beam is at the fourth position,
(Continued)

the second movable beam is separated from the fixed beam, and the first movable beam and the fixed beam form a second passage.

18 Claims, 2 Drawing Sheets

(51) Int. Cl.
*B61L 5/04* (2006.01)
*B61L 5/10* (2006.01)

(58) Field of Classification Search
CPC .... E01B 25/12; E01B 2202/042; E01B 25/26; B61L 5/04; B61L 5/10; B61L 5/02; B61L 5/065; B61L 5/026
See application file for complete search history.

(56) References Cited

U.S. PATENT DOCUMENTS 1,377,653 A * 5/1921 Ballard ..... B61L 23/002 104/102
1,414,303 A * 4/1922 Reid ..... B61L 23/002 104/102
2,840,006 A * 6/1958 Henderson ..... B61L 23/002 191/38
3,905,302 A 9/1975 Fink et al.
5,184,791 A 2/1993 Kais et al.

FOREIGN PATENT DOCUMENTS

| | | | | | |
|---|---|---|---|---|---|
| CN | 101449003 | A | | 6/2009 | |
| CN | 102107668 | A | | 6/2011 | |
| CN | 201907530 | U | | 7/2011 | |
| CN | 102162208 | A | | 8/2011 | |
| CN | 201932197 | U | | 8/2011 | |
| CN | 102787536 | A | | 11/2012 | |
| CN | 102817289 | A | | 12/2012 | |
| CN | 103132404 | A | | 6/2013 | |
| CN | 103276643 | A | | 9/2013 | |
| CN | 103696331 | A | | 4/2014 | |
| CN | 105155366 | A | | 12/2015 | |
| CN | 105239471 | A | | 1/2016 | |
| CN | 105839482 | A | | 8/2016 | |
| DE | 4332493 | A1 | * | 3/1995 | ..... B61L 5/10 |
| JP | 52057604 | A | * | 5/1977 | |
| JP | 2004204455 | A | | 7/2004 | |

* cited by examiner

TURNOUT AND TURNOUT ASSEMBLY

CROSS-REFERENCE TO RELATED APPLICATIONS

This application is the U.S. national phase entry of PCT Application No. PCT/CN2017/089200, filed Jun. 20, 2017, which claims priority to Chinese Patent Application Serial No. 201611250107.7, filed with the State Intellectual Property Office of P. R. China on Dec. 29, 2016. The entire contents of the above-referenced applications are incorporated herein by reference.

FIELD

The present disclosure relates to the field of traffic technology, more particularly to a turnout and turnout assembly.

BACKGROUND

In related technologies, due to the linear structure of a turnout and the limitation of vehicle bound, a turnout platform occupies a large area, turnout beams are heavy, and the power of a driving device is high, which causes waste of resources to some extent. Therefore, an improvement is needed.

SUMMARY

An objective of the present disclosure is to at least resolve one of the technical problems in the related art to some extent. Thus, the present disclosure provides a turnout, which has the advantages of simple structure, small occupied area, light weight, and small quantity of turnout tracks.

The present disclosure also provides a turnout assembly with the turnout.

A turnout according to an embodiment of a first aspect of the present disclosure comprises: a fixed beam, the fixed beam being arranged on a turnout platform; and a first movable beam and a second movable beam, wherein the first movable beam and the second movable beam are respectively arranged on two opposite sides of the fixed beam, the first movable beam is movably arranged on the turnout platform between a first position and a second position, and the second movable beam is movably arranged on the turnout platform between a third position and a fourth position; when the first movable beam is at the first position, the second movable beam is at the third position, the first movable beam is separated from the fixed beam, and the second movable beam and the fixed beam form a first passage; and when the first movable beam is at the second position, the second movable beam is at the fourth position, the second movable beam is separated from the fixed beam, and the first movable beam and the fixed beam form a second passage.

A turnout assembly according to an embodiment of a second aspect of the present disclosure comprises: the turnout according to the embodiment of the first aspect of the present disclosure; a first trolley and a second trolley, wherein the first trolley and the second trolley are movably arranged on the turnout platform and located below the turnout, the first trolley and the second trolley are spaced in the extension direction of the turnout, two ends of the first movable beam are connected to the first trolley and the second trolley respectively, and two ends of the second movable beam are connected to the first trolley and the second trolley respectively; and a driving device for driving the first movable beam and the second movable beam to move, the driving device being arranged on the turnout platform.

Figure 1:
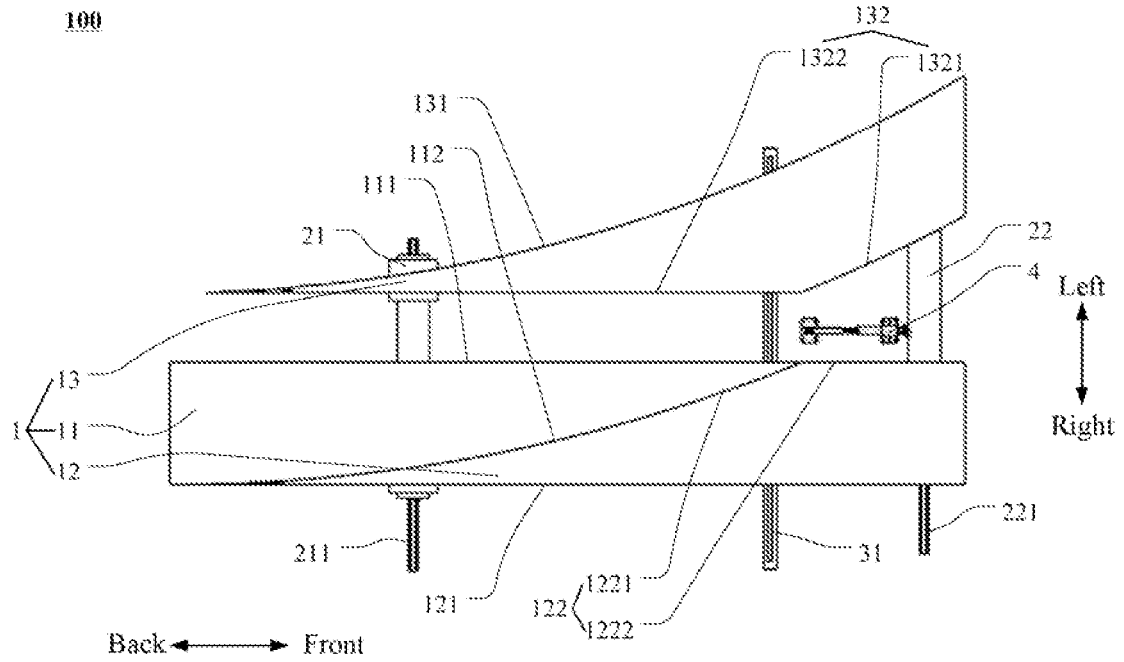
FIG. 1 is a schematic view of a turnout assembly according to an embodiment of the present disclosure.

Reference numerals of the accompanying drawing:

Turnout assembly 100,

Turnout 1,

Fixed beam 11, first fixed edge 111, second fixed edge 112,

First movable beam 12, first movable edge 121, second movable edge 122, first curved segment 1221, first straight segment 1222, Second movable beam 13, third movable edge 131, fourth movable edge 132, second curved segment 1321, second straight segment 1322, First trolley 21, first traveling rail 211, second trolley 22, second traveling rail 221, first locking groove 222, second locking groove 223, flange structure 23, Driving device 3, guide rail 31, guide wheel 32, wheel body 321, wheel carrier 322, frame 33, ear plate 34, driving cylinder 35, cylinder body 351, piston rod 352, support frame 353, Locking device 4, locking shaft 41, locking roller 411, locking cylinder 42, connecting bracket 421, positioning assembly 43, fixing bracket 431, positioning sleeve 432.

DETAILED DESCRIPTION

The embodiments of the present disclosure are described in detail below. Examples of the embodiments are illustrated in the accompanying drawings. The embodiments described below with reference to the accompanying drawings are exemplary, aim to explain the disclosure, but cannot be understood as a limitation on the disclosure.

In descriptions of the present disclosure, it should be understood that direction or position relationships indicated by terms such as "center", "length", "width", "thickness", "above", "below", "front", "back", "left", "right", "vertical", "horizontal", "top", "bottom", "inner", and "outer" are direction or position relationships based on the accompanying drawings, and are used only for conveniently describing the present disclosure and simplifying descriptions, instead of indicating or suggesting that a represented apparatus or component needs to have a particular direction or is constructed and operated in a particular direction, and therefore shall not be understood as limiting the present disclosure.

In addition, terms "first" and "second" are used only for description purposes, and shall not be understood as indicating or suggesting relative importance or implicitly indicating a quantity of indicated technical features. Therefore, features defined by "first" and "second" may explicitly or implicitly include at least one feature. In the description of the present disclosure, unless otherwise specifically limited, "multiple" means at least two, for example, two or three.

In the present disclosure, it should be noted that unless otherwise clearly specified and limited, the terms "mounted", "connected", "connection", and "fixed" should be understood in a broad sense. For example, a connection may be a fixed connection, a detachable connection, or an integral connection; may be a mechanical connection or an electrical connection, or mutual communication; may be a direct connection or an indirect connection by means of an intermediate medium; or may be internal communication between two elements or interaction relationship between two elements, unless otherwise clearly limited. A person of ordinary skill in the art may understand specific meanings of the foregoing terms in this disclosure according to a specific situation.

The following describes a turnout 1 according to an embodiment of a first aspect of the present disclosure with reference to FIG. 1.

As shown in FIG. 1, a turnout 1 according to an embodiment of a first aspect of the present disclosure comprises a fixed beam 11, a first movable beam 12, and a second movable beam 13. The turnout 1 may be a straddle type monorail turnout.

The fixed beam 11 is arranged on a turnout platform, and the fixed beam 11 is fixed relative to the turnout platform. The first movable beam 12 and the second movable beam 13 are respectively arranged on two opposite sides of the fixed beam 11. For example, referring to the example of FIG. 1, the fixed beam 11 may extend in the front-back direction, and the first movable beam 12 and the second movable beam 13 are respectively arranged on the left and right sides of the fixed beam 11. The first movable beam 12 is movably arranged on the turnout platform between a first position and a second position, and the second movable beam 13 is movably arranged on the turnout platform between a third position and a fourth position. When the first movable beam 12 is at the first position, the second movable beam 13 is at the third position, the first movable beam 12 is separated from the fixed beam 11, and the second movable beam 13 and the fixed beam 11 form a first passage. When the first movable beam 12 is at the second position, the second movable beam 13 is at the fourth position, as shown in FIG. 1, the second movable beam 13 is separated from the fixed beam 11, and the first movable beam 12 and the fixed beam 11 form a second passage. The extension directions of the first passage and the second passage are different.

It should be noted that the first movable beam 12 and the second movable beam 13 are movably synchronously in the same direction. When the first movable beam 12 and the second movable beam 13 move in a first direction (referring to the right direction in FIG. 1), the first movable beam 12 is away from the fixed beam 11, and the second movable beam 13 is close to the fixed beam 11. When the first movable beam 12 moves to the first position, the second movable beam 13 moves to the third position, the first movable beam 12 is separated from the fixed beam 11, a safety distance required by the vehicle bound is kept between the first movable beam 12 and the fixed beam 11, and the second movable beam 13 is in contact with the fixed beam 11 to form a complete first passage, whereby a vehicle may travel through the first passage.

When the first movable beam 12 and the second movable beam 13 move in a second direction (referring to the left direction in FIG. 1) opposite to the first direction, the first movable beam 12 is close to the fixed beam 11, and the second movable beam 13 is away from the fixed beam 11. When the first movable beam 12 moves to the second position, the second movable beam 13 moves to the fourth position, the second movable beam 13 is separated from the fixed beam 11, a safety distance required by the vehicle bound is kept between the second movable beam 13 and the fixed beam 11, and the first movable beam 12 is in contact with the fixed beam 11 to form a complete second passage, whereby a vehicle may travel through the second passage.

The turnout 1 is configured to comprise the fixed beam 11, the first movable beam 12 and the second movable beam 13, and the first movable beam 12 and the second movable beam 13 are movable to switch the second passage and the first passage, so that the passage on which the vehicle travels may be conveniently switched.

It may be appreciated that the fixed beam 11, the first movable beam 12 and the second movable beam 13 may be regarded as half beams, the fixed beam 11 is fixed, the first movable beam 12 and the second movable beam 13 are movable, and two of the three half beams are moved to form a complete second or first passage. For the conventional turnout, usually complete first and second passages are moved. Compared with the conventional turnout, the occupied area and size of the turnout 1 according to the present disclosure are reduced, and the size and weight of the beams to be moved are also reduced, thereby reducing the driving power of a driving device for driving the first movable beam 12 and the second movable beam 13, and reducing the waste of resources.

Moreover, the quantity of turnout tracks of the turnout 1 with the above structure is only affected by the width and bound of a vehicle instead of the width of beams, so the quantity of turnout tracks is greatly reduced relative to that of the conventional turnout, the structure of the turnout may be simplified, and materials used may be saved.

The turnout 1 according to the embodiment of the present disclosure is configured to comprise a fixed beam 11, a first movable beam 12 and a second movable beam 13, the first movable beam 12 and the second movable beam 13 are moved such that the first movable beam 12 is separated from the fixed beam 11 and the second movable beam 13 is in contact with the fixed beam 11 to form a first passage, and the second movable beam 13 is separated from the fixed beam 11 and the first movable beam 12 is in contact with the fixed beam 11 to form a second passage. Therefore, the vehicle passage may be conveniently switched, the occupied area and weight of the turnout 1 with the above structure may be reduced, and the quantity of turnout tracks of the turnout 1 is greatly reduced relative to that of the conventional turnout.

In some embodiments of the present disclosure, referring to FIG. 1, the first passage is a curved beam, and the second passage is a straight beam. For example, in the specific example of FIG. 1, the fixed beam 11 comprises a first fixed edge 111 and a second fixed edge 112 that are opposite, the first fixed edge 111 extends along a straight line, and the second fixed edge 112 extends along a curve. The first movable beam 12 comprises a first movable edge 121 and a second movable edge 122 that are opposite, the first movable edge 121 is on the side of the first movable beam 12 away from the fixed beam 11, the second movable edge 122 is on the side of the first movable beam 12 adjacent to the fixed beam 11, and the first movable edge 121 extends along a straight line. The second movable edge 122 comprises a first curved segment 1221 and a first straight segment 1222 that are connected to each other, the first curved segment 1221 extends along a curve, and the first straight segment 1222 extends along a straight line. In the traveling direction of the vehicle (referring to the forward direction in FIG. 1), the first straight segment 1222 of the second movable edge 122 may be in front of the first curved segment 1221.

The second movable beam 13 comprises a third movable edge 131 and a fourth movable edge 132 that are opposite, the third movable edge 131 is on the side of the second movable beam 13 away from the fixed beam 11, and the fourth movable edge 132 is on the side of the second movable beam 13 adjacent to the fixed beam 11. The third movable edge 131 extends along a curve, the fourth movable edge 132 comprises a second curved segment 1321 and a second straight segment 1322 that are connected to each other, the second curved segment 1321 extends along a curve, and the second straight segment 1322 extends along a straight line. In the traveling direction of the vehicle (referring to the forward direction in FIG. 1), the second curved segment 1321 of the fourth movable edge 132 may be in front of the second straight segment 1322.

When the first movable beam 12 is at the first position and the second movable beam 13 is at the third position, the first movable beam 12 is separated from the fixed beam 11, and the second movable beam 13 is in contact with the fixed beam 11 to form a curved beam. At this time, the first fixed edge 111 of the fixed beam 11 coincides with the second straight segment 1322 of the second movable beam 13, the third movable edge 131 of the second movable beam 13 forms a curved edge of the curved beam, and the second fixed edge 112 of the fixed beam 11 and the second curved segment 1321 of the second movable beam 13 form the other curved edge of the curved beam, so that the second movable beam 13 is in contact with the fixed beam 11 to form a complete curved beam for curved traveling.

When the first movable beam 12 is at the second position and the second movable beam 13 is at the fourth position, the second movable beam 13 is separated from the fixed beam 11, and the first movable beam 12 is in contact with the fixed beam 11 to form a straight beam. At this time, the second fixed edge 112 of the fixed beam 11 coincides with the first curved segment 1221 of the first movable beam 12, the first movable edge 121 of the first movable beam 12 forms a straight edge of the straight beam, and the first fixed edge 111 of the fixed beam 11 and the first straight segment 1222 of the first movable beam 12 form the other straight edge of the straight beam, so that the first movable beam 12 is in contact with the fixed beam 11 to form a complete straight beam for straight traveling.

The fixed beam 11, the first movable beam 12 and the second movable beam 13 are arranged as the above structure, so that the structure of the turnout may be simplified. The first movable beam 12 and the second movable beam 13 may be in seamless contact with the fixed beam 11 respectively, which facilitates the combination of the first movable beam 12 and the second movable beam 13 moving to a set position and the fixed beam 11 into a complete straight beam or curved beam, thereby realizing the function of curved traveling or straight traveling.

The following describes a turnout assembly 100 according to an embodiment of a second aspect of the present disclosure with reference to FIG. 1 to FIG. 5.

As shown in FIG. 1 to FIG. 5, a turnout assembly 100 according to an embodiment of a second aspect of the present disclosure comprises: the turnout 1 according to the embodiment of the first aspect of the present disclosure, a driving device 3, a first trolley 21, and a second trolley 22.

The first trolley 21 and the second trolley 22 are movably arranged on the turnout platform and located below the turnout, the first trolley 21 and the second trolley 22 are spaced in the extension direction of the turnout (referring to FIG. 1, the first trolley 21 and the second trolley 22 may be spaced in the front-back direction), two ends of the first movable beam 12 are connected to the first trolley 21 and the second trolley 22 respectively, and two ends of the second movable beam 13 are connected to the first trolley 21 and the second trolley 22 respectively. Alternatively, the first movable beam 12 may be connected with the first trolley 21 and the second trolley 22 by flange structures 23 respectively, and the second movable beam 13 may be connected with the first trolley 21 and the second trolley 22 by flange structures 23 respectively.

The first trolley 21 and the second trolley 22 may play a role in supporting the first movable beam 12 and the second movable beam 13. Because the first movable beam 12 and the second movable beam 13 are respectively connected with the first trolley 21 and the second trolley 22, the first movable beam 12 and the second movable beam 13 are fixed relative to the first trolley 21 and the second trolley 22, and the distance between the first movable beam 12 and the second movable beam 13 (referring to FIG. 1, the spacing distance between the first movable beam 12 and the second movable beam 13 in the left-right direction) is also constant.

A first traveling rail 211 and a second traveling rail 221 for guiding the traveling of the first trolley 21 and the second trolley 22 respectively may also be arranged on the turnout platform, and the extension direction of the first traveling rail 211 and the second traveling rail 221 may be the same as the moving direction of the first movable beam 12 and the second movable beam 13 (referring to FIG. 1, the first traveling rail 211 and the second traveling rail 221 may extend in the left-right direction). The first trolley 21 is arranged on the first traveling rail 211 and movable along the first traveling rail 211, and the second trolley 22 is arranged on the second traveling rail 221 and movable along the second traveling rail 221.

The driving device 3 is arranged on the turnout platform, and used to drive the first movable beam 12 and the second movable beam 13 to move. The driving device 3 may be connected with the first movable beam 12 and the second movable beam 13 to drive the first movable beam 12 and the second movable beam 13 to move. Thus, when the driving device 3 drives the first movable beam 12 and the second movable beam 13 to move, the first trolley 21 and the second trolley 22 follow the first movable beam 12 and the second movable beam 13 to move along the respective traveling rails.

For example, when the driving device 3 drives the first movable beam 12 and the second movable beam 13 to move in the first direction (referring to the right direction in FIG. 1), the first trolley 21 moves toward the first direction along the first traveling rail 211, the second trolley 22 moves toward the first direction along the second traveling rail 221, then the first movable beam 12 is away from the fixed beam 11, and the second movable beam 13 is close to the fixed beam 11. When the first movable beam 12 moves to the first position, the second movable beam 13 moves to the third position, the first movable beam 12 is separated from the fixed beam 11, a safety distance required by the vehicle bound is kept between the first movable beam 12 and the fixed beam 11, the second movable beam 13 is in contact with the fixed beam 11 to form a complete first passage, and a vehicle may travel through the first passage. For example, when the first passage is a curved beam, curved traveling may be achieved.

For another example, when the driving device 3 drives the first movable beam 12 and the second movable beam 13 to move in the second direction (referring to the left direction in FIG. 1), the first trolley 21 moves toward the second direction along the first traveling rail 211, the second trolley 22 moves toward the second direction along the second traveling rail 221, then the first movable beam 12 is close to the fixed beam 11, and the second movable beam 13 is away from the fixed beam 11. When the first movable beam 12 moves to the second position, the second movable beam 13 moves to the fourth position, the second movable beam 13 is separated from the fixed beam 11, a safety distance required by the vehicle bound is kept between the second movable beam 13 and the fixed beam 11, the first movable beam 12 is in contact with the fixed beam 11 to form a complete second passage, and a vehicle may travel through the second passage. For example, when the second passage is a straight beam, straight traveling may be achieved.

The turnout assembly 100 according to the embodiment of the present disclosure is provided with the turnout 1, so that the passage on which the vehicle travels may be switched. Because the weight of the turnout is reduced, the driving power of the driving device 3 is reduced, the cost is lowered, resources are saved, and the occupied area and the quantity of turnout tracks of the turnout assembly 100 are reduced.

In some embodiments of the present disclosure, referring to FIG. 1 and FIG. 3, the driving device 3 may be located below the turnout, and the driving device 3 comprises a guide rail 31, two guide assemblies, and a driving cylinder 35. The guide rail 31 is arranged on the turnout platform and extends in a direction parallel to the moving direction of the first movable beam 12 and the second movable beam 13 (referring to FIG. 1, the guide rail 31 may extend in the left-right direction). The two guide assemblies are slidable along the guide rail 31, the two guide assemblies are respectively arranged at two ends of the guide rail 31 (referring to FIG. 3, the two guide assemblies may be respectively arranged at the left and right ends of the guide rail 31), and the first movable beam 12 and the second movable beam 13 are respectively connected with the two guide assemblies. The driving cylinder 35 comprises a cylinder body 351 and a piston rod 352 movably arranged in the cylinder body 351 and extending in the extension direction of the guide rail 31 (referring to FIG. 3, the piston rod 352 may extend in the left-right direction), a support frame 353 may be connected to the cylinder body 351, the support frame 353 is arranged on the turnout platform and may stably support the driving cylinder 35, and two ends of the piston rod 352 (referring to FIG. 3, the left and right ends of the piston rod 352) extend out of the cylinder body 351 and are connected with the two guide assemblies respectively.

When the driving cylinder 35 is in operation, the movement of the piston rod 352 may drive the two guide assemblies to move in the same direction along the guide rail 31, so that the first movable beam 12 and the second movable beam 13 connected with the two guide assemblies respectively may be driven to move toward the same direction. For example, referring to the example of FIG. 1 and FIG. 3, when the piston rod 352 moves right, the two guide assemblies are driven to move right at the same time, the first movable beam 12 and the second movable beam 13 are also driven to move right, and the first trolley 21 and the second trolley 22 also move right; when the first movable beam 12 moves to the first position, the second movable beam 13 moves to the third position, the first movable beam 12 is separated from the fixed beam 11, a safety distance required by the vehicle bound is kept between the first movable beam 12 and the fixed beam 11, and the second movable beam 13 is in contact with the fixed beam 11 to form a complete first passage, whereby a vehicle may travel through the first passage. When the piston rod 352 moves left, the two guide assemblies are driven to move left at the same time, the first movable beam 12 and the second movable beam 13 are also driven to move left, and the first trolley 21 and the second trolley 22 also move left; when the first movable beam 12 moves to the second position, the second movable beam 13 moves to the fourth position, the second movable beam 13 is separated from the fixed beam 11, a safety distance required by the vehicle bound is kept between the second movable beam 13 and the fixed beam 11, and the first movable beam 12 is in contact with the fixed beam 11 to form a complete second passage, whereby a vehicle may travel through the second passage.

It may be appreciated that because the first movable beam 12 and the second movable beam 13 are driven to move by the same driving cylinder 35, the first movable beam 12 and the second movable beam 13 may be ensured to move synchronously, the phenomenon of asynchrony caused by the conventional motor may be avoided, and the operating reliability and stability of the turnout assembly 100 may be improved.

Alternatively, referring to FIG. 1, the driving device 3 may be located between the first trolley 21 and the second trolley 22. The driving device 3 may be located substantially at the center of gravity of the turnout, so that the portions of the turnout on two sides of the driving device 3 are relatively balanced, and the first movable beam 12 and the second movable beam 13 may be driven to move more stably.

Figure 3:
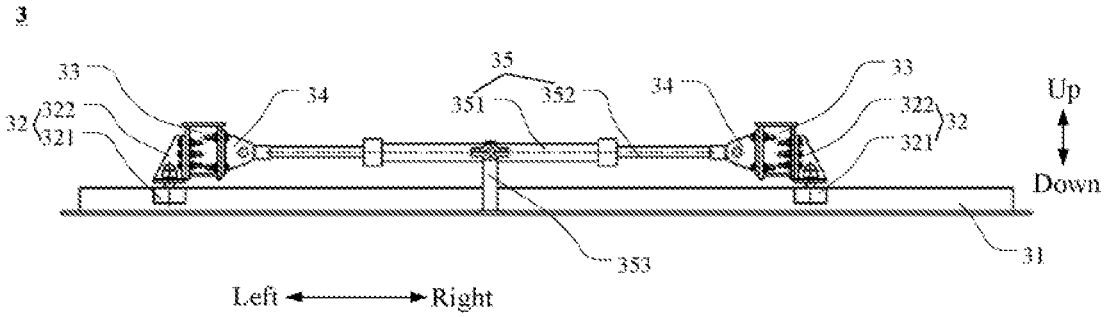
FIG. 3 is a front view of a driving device of the turnout assembly according to an embodiment of the present disclosure.
Figure 4:
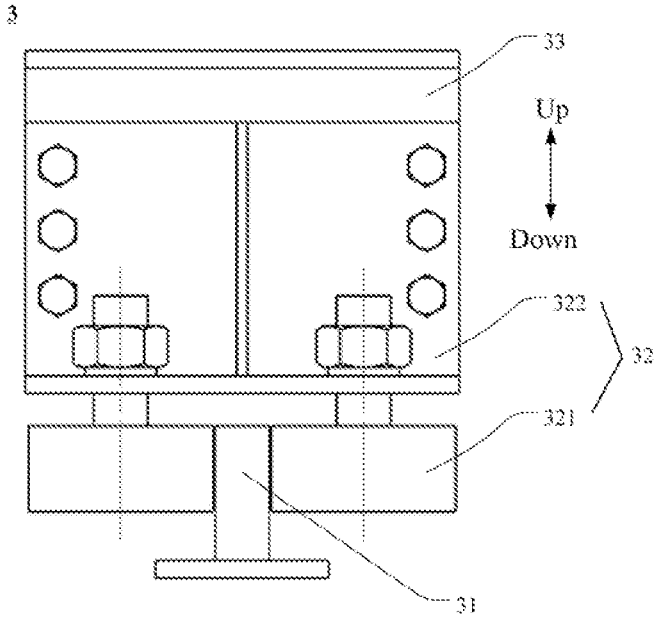
FIG. 4 is a side view of the driving device of the turnout assembly according to an embodiment of the present disclosure.

Further, referring to FIG. 3 and FIG. 4, each guide assembly comprises a guide wheel 32 and a frame 33, the guide wheel 32 is arranged on the guide rail 31 and slidable along the guide rail 31, and the frame 33 is connected with the guide wheel 32. The first movable beam 12 and the second movable beam 13 are connected with the frames 33 of the two guide assemblies respectively, and the two ends of the piston rod 352 are connected with the frames 33 of the two guide assemblies respectively. The guide wheels 32 facilitate the movement of the guide assemblies along the guide rail 31, and the frames 33 facilitate the connection of the driving cylinder 35, the first movable beam 12 and the second movable beam 13 with the guide assemblies. For example, in the example of FIG. 3 and FIG. 4, the piston rod 352 of the driving cylinder 35 may be connected with the frames 33 by ear plates 34, and the piston rod 352 may be connected with the ear plates 34 by pins. The guide wheel 32 may comprise a wheel body 321 and a wheel carrier 322, the wheel body 321 is connected to the wheel carrier 322, the wheel body 321 is arranged on the guide rail 31 and slidable along the guide rail 31, and the wheel carrier 322 is connected with the frame 33.

In some embodiments of the present disclosure, referring to FIG. 1, the turnout assembly 100 further comprises a locking device 4 for locking the first movable beam 12 and the second movable beam 13 to set positions, the locking device 4 being arranged on the turnout platform. The locking device 4 may lock the first movable beam 12 and the second movable beam 13 to the set positions, thereby preventing the first movable beam 12 and the second movable beam 13 from moving. For example, when the first movable beam 12 moves to the first position and the second movable beam 13 moves to the third position, the locking device 4 locks the first movable beam 12 to the first position and locks the second movable beam 13 to the third position, so that a safety distance required by the vehicle bound is kept between the first movable beam 12 and the fixed beam 11, and the second movable beam 13 is in contact with the fixed beam 11 to form a complete first passage. For another example, when the first movable beam 12 moves to the second position and the second movable beam 13 moves to the fourth position, the locking device 4 locks the first movable beam 12 to the second position and locks the second movable beam 13 to the fourth position, so that a safety distance required by the vehicle bound is kept between the second movable beam 13 and the fixed beam 11, and the first movable beam 12 is in contact with the fixed beam 11 to form a complete second passage.

It may be appreciated that when the first movable beam 12 and the second movable beam 13 need to move, the locking device 4 unlocks the first movable beam 12 and the second movable beam 13 to realize the movement of the first movable beam 12 and the second movable beam 13.

Alternatively, the locking device 4 may be adapted to be connected to one of the first trolley 21 and the second trolley 22 to lock the first movable beam 12 and the second movable beam 13 to the set positions. For example, the locking device 4 may be adapted to be connected to the first trolley 21. When the first movable beam 12 and the second movable beam 13 move to the set positions, the locking device 4 is connected to the first trolley 21 to lock the first trolley 21, so that the first movable beam 12 and the second movable beam 13 are locked to the set positions. For another example, the locking device 4 may also be adapted to be connected to the second trolley 22. When the first movable beam 12 and the second movable beam 13 move to the set positions, the locking device 4 is connected to the second trolley 22 to lock the second trolley 22, so that the first movable beam 12 and the second movable beam 13 are locked to the set positions.

Of course, when the first movable beam 12 and the second movable beam 13 need to move, the locking device 4 is separated from the first trolley 21 or the second trolley 22 for unlocking, thereby realizing the movement of the first movable beam 12 and the second movable beam 13.

Figure 2:
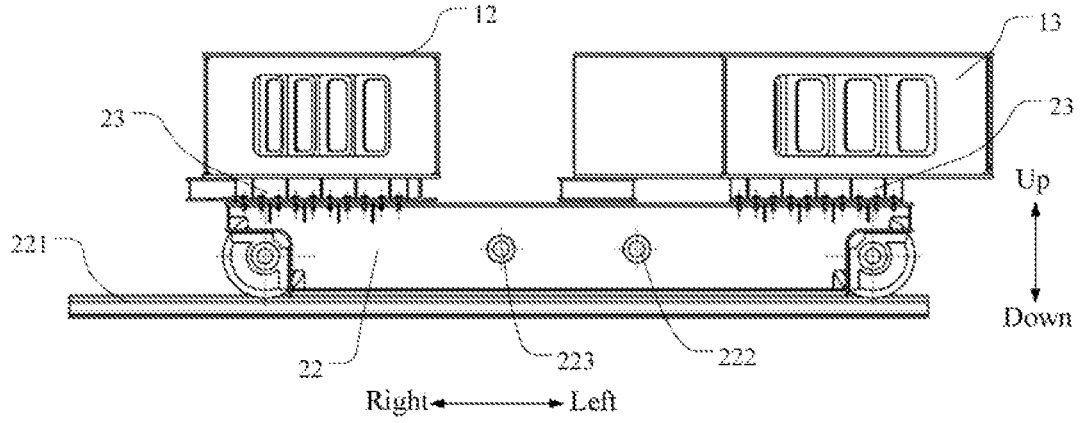
FIG. 2 is a schematic view indicating that a first movable beam and a second movable beam of the turnout assembly cooperate with a second trolley according to an embodiment of the present disclosure.
Figure 5:
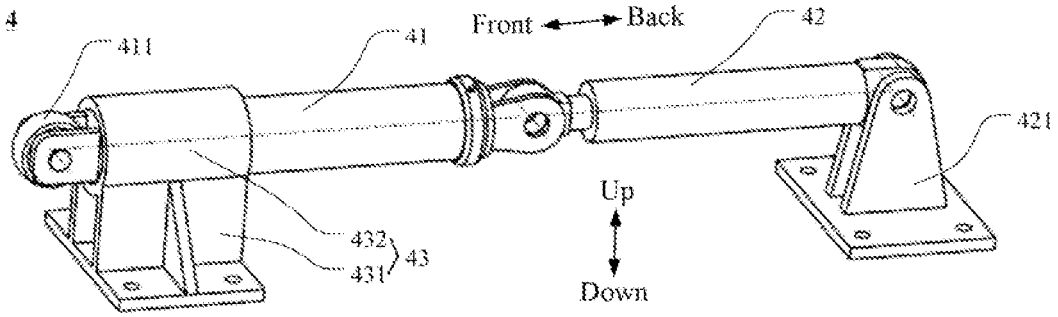
FIG. 5 is a three-dimensional view of a locking device of the turnout assembly according to an embodiment of the present disclosure.

In an embodiment of the present disclosure, referring to FIG. 2 and FIG. 5, the locking device 4 is adapted to be connected to the second trolley 22, and the second trolley 22 is provided with a first locking groove 222 and a second locking groove 223 spaced in the moving direction of the first movable beam 12 and the second movable beam 13. The locking device 4 comprises a locking shaft 41 and a locking cylinder 42, the locking shaft 41 is adapted to engage with the first locking groove 222 or the second locking groove 223, the locking cylinder 42 is arranged on the turnout platform, the locking cylinder 42 may be fixed to the turnout platform through a connecting bracket 421, and the locking cylinder 42 is connected to the locking shaft 41 to drive the locking shaft 41 to move in the axial direction.

When the first movable beam 12 is at the first position and the second movable beam 13 is at the third position, the locking cylinder 42 drives the locking shaft 41 to move toward the first locking groove 222 of the second trolley 22, and when the free end of the locking shaft 41 moves into the first locking groove 222 and engages with the first locking groove 222, the first movable beam 12 is locked to the first position and the second movable beam 13 is locked to the third position. When the first movable beam 12 is at the second position and the second movable beam 13 is at the fourth position, the locking cylinder 42 drives the locking shaft 41 to move toward the second locking groove 223 of the second trolley 22, and when the free end of the locking shaft 41 moves into the second locking groove 223 and engages with the second locking groove 223, the first movable beam 12 is locked to the second position and the second movable beam 13 is locked to the fourth position.

Of course, when the first movable beam 12 and the second movable beam 13 need to move, the locking cylinder 42 drives the locking shaft 41 to move away from the second trolley 22, so that the locking shaft 41 is disengaged from the first locking groove 222 or the second locking groove 223 to unlock the second trolley 22, and then the first movable beam 12 and the second movable beam 13 can move.

Thus, the first movable beam 12 and the second movable beam 13 may be locked and unlocked by the reciprocating movement of the locking shaft 41 driven by the locking cylinder 42, and the locking device 4 is simple in structure and convenient to use.

Further, referring to FIG. 5, the locking device 4 may further comprise a positioning assembly 43, the positioning assembly 43 comprises a fixing bracket 431 arranged on the turnout platform and a positioning sleeve 432 connected to the fixing bracket 431, the fixing bracket 431 is used for fixing and supporting the positioning sleeve 432, the free end of the locking shaft 41 penetrates through the positioning sleeve 432, and the locking shaft 41 is axially movable relative to the positioning sleeve 432. Thus, when the locking shaft 41 moves, the locking shaft 41 may be ensured to move in the set direction by the limiting of the positioning sleeve 432, so that the free end of the locking shaft 41 may be surely inserted into the first locking groove 222 or the second locking groove 223. Alternatively, a locking roller 411 may be arranged at the free end of the locking shaft 41, and the locking roller 411 is inserted into the first locking groove 222 or the second locking groove 223 to lock the first movable beam 12 and the second movable beam 13.

In the descriptions of this specification, descriptions such as reference terms "an embodiment", "some embodiments", "example", "specific example", or "some examples" intend to indicate that specific features, structures, materials, or characteristics described with reference to embodiments or examples are included in at least one embodiment or example of this disclosure. In this specification, exemplary descriptions of the foregoing terms do not necessarily refer to a same embodiment or example. In addition, the described specific features, structures, materials, or characteristics may be combined in a proper manner in any one or more of the embodiments or examples. In addition, a person skilled in the art may integrate or combine different embodiments or examples and characteristics of different embodiments or examples described in the specification, as long as they do not conflict each other.

Although the embodiments of the present disclosure are shown and described above, it may be understood that the foregoing embodiments are examples, and cannot be understood as limitations to the present disclosure. A person of ordinary skill in the art may make changes, modifications, replacements, and variations to the foregoing embodiments without departing from the scope of the present disclosure.

What is claimed is:

1. A turnout, comprising:

a fixed beam comprising a first fixed edge and a second fixed edge that are opposite, the fixed beam being arranged on a turnout platform; and a first movable beam comprising a first moveable edge and a second moveable edge that are opposite, the first moveable edge extending in a straight line and the second moveable edge having a first curved segment and a first straight segment that are connected to each other; and a second movable beam comprising a third moveable edge and a fourth movable edge that are opposite, the third moveable edge extending along a curve and the fourth movable edge having a second curved segment and a second straight segment that are connected to each other;

wherein the first movable beam and the second movable beam are respectively arranged on two opposite sides of the fixed beam, the first movable beam is movably arranged on the turnout platform between a first position and a second position, and the second movable beam is movably arranged on the turnout platform between a third position and a fourth position;

wherein when the first movable beam is at the first position, the second movable beam is at the third position, the first movable beam is separated from the fixed beam, and the second movable beam and the fixed beam form a first passage;

wherein when the first movable beam is at the second position, the second movable beam is at the fourth position, the second movable beam is separated from the fixed beam, and the first movable beam and the fixed beam form a second passage; and wherein the first passage is a curved beam and the second passage is a straight beam;

wherein the first fixed edge extends along a straight line and the second fixed edge extends along a curve:

wherein when the second movable beam is at the third position, the second fixed edge and the second curved segment form a continuous curved line; and wherein when the first movable beam is in the second position, the first fixed edge and the first straight segment form a continuous straight line.

2. The turnout according to claim 1, wherein the first curved segment extends along a curve, and the first straight segment extends along a straight line;

wherein the second curved segment extends along a curve, and the second straight segment extends along a straight line;

when the first movable beam is at the first position and the second movable beam is at the third position, the first fixed edge coincides with the second straight segment, the third movable edge forms a curved edge of the curved beam, and the second fixed edge and the second curved segment form the other curved edge of the curved beam; and when the first movable beam is at the second position and the second movable beam is at the fourth position, the second fixed edge coincides with the first curved segment, the first movable edge forms a straight edge of the straight beam, and the first fixed edge and the first straight segment form the other straight edge of the straight beam.

3. A turnout assembly, comprising:

the turnout according to claim 1;

a first trolley and a second trolley, wherein the first trolley and the second trolley are movably arranged on the turnout platform and located below the turnout, the first trolley and the second trolley are spaced in an extension direction of the turnout, two ends of the first movable beam are connected to the first trolley and the second trolley respectively, and two ends of the second movable beam are connected to the first trolley and the second trolley respectively; and a driving device for driving the first movable beam and the second movable beam to move, the driving device being arranged on the turnout platform.

4. The turnout assembly according to claim 3, wherein the driving device is located below the turnout, and the driving device comprises:

a guide rail, arranged on the turnout platform and extending in a direction parallel to a moving direction of the first movable beam and the second movable beam;

two guide assemblies, slidable along the guide rail, wherein the two guide assemblies are respectively arranged at two ends of the guide rail, and the first movable beam and the second movable beam are respectively connected with the two guide assemblies; and a driving cylinder, comprising:

a cylinder body, and a piston rod, movably arranged in the cylinder body and extending in an extension direction of the guide rail, two ends of the piston rod extending out of the cylinder body and being connected with the two guide assemblies respectively.

5. The turnout assembly according to claim 3, wherein the driving device is located between the first trolley and the second trolley.

6. The turnout assembly according to claim 4, wherein each guide assembly comprises:

a guide wheel, arranged on the guide rail and slidable along the guide rail; and a frame, connected with the guide wheel, wherein the first movable beam and the second movable beam are connected with the frames of the two guide assemblies respectively, and the two ends of the piston rod are connected with the frames of the two guide assemblies respectively.

7. The turnout assembly according to claim 3, further comprising a locking device for locking the first movable beam and the second movable beam to set positions, the locking device being arranged on the turnout platform.

8. The turnout assembly according to claim 7, wherein the locking device is configured to be connected to one of the first trolley and the second trolley to lock the first movable beam or the second movable beam correspondingly to the set positions.

9. The turnout assembly according to claim 8, wherein the locking device is configured to be connected to the second trolley, the second trolley is provided with a first locking groove and a second locking groove spaced in the moving direction of the first movable beam and the second movable beam, and the locking device comprises:

a locking shaft, configured to engage with the first locking groove or the second locking groove; and a locking cylinder, arranged on the turnout platform and connected to the locking shaft to drive the locking shaft to move in an axial direction, when the first movable beam is at the first position and the second movable beam is at the third position, the locking shaft engages with the first locking groove to lock the first movable beam to the first position and to lock the second movable beam to the third position, and when the first movable beam is at the second position and the second movable beam is at the fourth position, the locking shaft engages with the second locking groove to lock the first movable beam to the second position and to lock the second movable beam to the fourth position.

10. The turnout assembly according to claim 9, wherein the locking device further comprises a positioning assembly, the positioning assembly comprises a fixing bracket arranged on the turnout platform and a positioning sleeve connected to the fixing bracket, a free end of the locking shaft penetrates through the positioning sleeve, and the locking shaft is axially movable relative to the positioning sleeve.

11. A turnout assembly, comprising:

the turnout according to claim 2;

a first trolley and a second trolley, wherein the first trolley and the second trolley are movably arranged on the turnout platform and located below the turnout, the first trolley and the second trolley are spaced in an extension direction of the turnout, two ends of the first movable beam are connected to the first trolley and the second trolley respectively, and two ends of the second movable beam are connected to the first trolley and the second trolley respectively; and a driving device for driving the first movable beam and the second movable beam to move, the driving device being arranged on the turnout platform.

12. The turnout assembly according to claim 11, wherein the driving device is located below the turnout, and the driving device comprises:

a guide rail, arranged on the turnout platform and extending in a direction parallel to a moving direction of the first movable beam and the second movable beam;

two guide assemblies, slidable along the guide rail, wherein the two guide assemblies are respectively arranged at two ends of the guide rail, and the first movable beam and the second movable beam are respectively connected with the two guide assemblies; and a driving cylinder, comprising:

a cylinder body, and a piston rod, movably arranged in the cylinder body and extending in an extension direction of the guide rail, two ends of the piston rod extending out of the cylinder body and being connected with the two guide assemblies respectively.

13. The turnout assembly according to claim 12, wherein the driving device is located between the first trolley and the second trolley.

14. The turnout assembly according to claim 13, wherein each guide assembly comprises:

a guide wheel, arranged on the guide rail and slidable along the guide rail; and a frame, connected with the guide wheel, wherein the first movable beam and the second movable beam are connected with the frames of the two guide assemblies respectively, and the two ends of the piston rod are connected with the frames of the two guide assemblies respectively.

15. The turnout assembly according to claim 11, further comprising a locking device for locking the first movable beam and the second movable beam to set positions, the locking device being arranged on the turnout platform.

16. The turnout assembly according to claim 15, wherein the locking device is configured to be connected to one of the first trolley and the second trolley to lock the first movable beam and the second movable beam to the set positions.

17. The turnout assembly according to claim 16, wherein the locking device is configured to be connected to the second trolley, the second trolley is provided with a first locking groove and a second locking groove spaced in the moving direction of the first movable beam and the second movable beam, and the locking device comprises:

a locking shaft, configured to engage with the first locking groove or the second locking groove;

and a locking cylinder, arranged on the turnout platform and connected to the locking shaft to drive the locking shaft to move in an axial direction, when the first movable beam is at the first position and the second movable beam is at the third position, the locking shaft engages with the first locking groove to lock the first movable beam to the first position and to lock the second movable beam to the third position, and when the first movable beam is at the second position and the second movable beam is at the fourth position, the locking shaft engages with the second locking groove to lock the first movable beam to the second position and to lock the second movable beam to the fourth position.

18. The turnout assembly according to claim 17, wherein the locking device further comprises a positioning assembly, the positioning assembly comprises a fixing bracket arranged on the turnout platform and a positioning sleeve connected to the fixing bracket, a free end of the locking shaft penetrates through the positioning sleeve, and the locking shaft is axially movable relative to the positioning sleeve.

* * * * *